United States Patent [19]

Tsuchitani et al.

[11] Patent Number: 4,731,261

[45] Date of Patent: Mar. 15, 1988

[54] METHOD FOR COATING A METAL COVERED WITH METAL OXIDE FILM WITH REFRACTORY METAL OXIDE

[75] Inventors: Kazuo Tsuchitani, Himeji; Shoichi Ichihara, Toyonaka; Tetsuji Ono, Amagasaki, all of Japan

[73] Assignee: Nippon Shokubai Kagaku Kogyo Co., Ltd., Osaka, Japan

[21] Appl. No.: 832,406

[22] Filed: Feb. 24, 1986

[30] Foreign Application Priority Data

Feb. 27, 1985 [JP] Japan ..... 60-36624

[51] Int. Cl.[4] ..... B05D 3/02

[52] U.S. Cl. ..... 427/376.5; 427/372.2; 427/376.3

[58] Field of Search ..... 427/376.2, 376.5, 372.2; 148/6.27, 6.14 R

[56] References Cited

U.S. PATENT DOCUMENTS

| | | | |
|---|---|---|---|
| 3,507,687 | 4/1970 | Laird | 427/376.5 |
| 3,630,789 | 12/1971 | Deyrup | 148/6.27 |
| 3,694,251 | 9/1972 | Houle et al. | 148/6.27 |
| 3,975,197 | 8/1976 | Mikelsons | 148/6.27 |
| 4,238,534 | 12/1980 | Ichida et al. | 427/376.5 |
| 4,279,782 | 7/1981 | Chapman et al. | 148/6.27 |
| 4,410,598 | 10/1983 | Kuzel et al. | 427/376.5 |

FOREIGN PATENT DOCUMENTS 1546097 5/1979 United Kingdom .

*Primary Examiner*—Janyce A. Bell

*Attorney, Agent, or Firm*—Sherman and Shalloway

[57] ABSTRACT

A coating method comprising coating a metal having a metal oxide film with a refractory metal oxide using an aqueous slurry containing said refractory metal oxide, which is characterized in that said refractory metal oxide has an average particle diameter ranging from 0.7–3 microns.

12 Claims, No Drawings

METHOD FOR COATING A METAL COVERED WITH METAL OXIDE FILM WITH REFRACTORY METAL OXIDE

This invention relates to a method for coating metal surfaces with refractory metal oxide. More particularly, the invention relates to a method for forming on metal surfaces a refractory metal oxide coating layer having excellent adhesion strength to the metal.

Metallic carriers having as their base material the metal foil of which surface is coated with refractory metal oxide are utilized to carry various catalytic components, and such catalysts are used for treating waste gases from internal combustion engines, e.g., automobile engine, and also those from large-sized boilers and general industrial waste gases; for catalytic combustion of combustible fuel; and for catalytic oxidation of ammonia, etc. And, as the metallic carriers have less heat capacity and excel in warming-up property, the catalysts using them can exhibit catalytic activity under low temperature conditions, more quickly than the catalysts with ceramic carriers. Also the metallic carrier characteristically gives much larger geometrical surface area compared with ceramic carrier of identical volume. Due to those characteristics, the metallic carrier can be expected to provide catalysts of higher activity than that of ceramic-carried catalysts.

However, it is required for the catalyst, for example, for treating waste gas of automobiles, to maintain stable performance under abrupt temperature changes. In order to use the metal-carried catalyst under such rigorous conditions, it is necessary to form a coating layer strongly adhered to the metal surface, but it has been heretofore held difficult to form so strongly adhered refractory metal oxide coating on metal surface through simple means. For this reason it has been difficult to have the metallic carriers fully exhibit their characteristics.

As the coating method of metal surfaces such as of iron sheet or stainless steel sheet with refractory metal oxide, for example British Patent No. 1,492,929 disclosed a method of precipitating alumina hydrate onto the metal surface from an aqueous solution of alkali metal aluminate. By this method, however, it is difficult to obtain a uniform coating layer. Also British Patent No. 1,546,097 disclosed a method for obtaining a strong coating layer, by immersing metal sheet in an alumina sol formed by adding water to dispersible alumina hydrate, and thereafter calcining the sheet at 1,100° C. The amount of alumina coating is little according to this method, however, and the calcining at such a high temperature as 1,100° C. is ineconomical.

U.S. Pat. No. 4,279,782 taught a two-stage coating process comprising wetting metal surface with aqueous alumina gel, and then applying thereto a coating material composed of macroceramic particles suspended in aqueous alumina gel. This process however requires cumbersome operations.

As above, it is the present status of the art that a method for forming a refractory metal oxide coating layer of sufficient coating amount and excellent adhesion strength to the metal surface to be coated, economically with simple means, has not yet been proposed, although keen demand for such a method has always existed.

The object of the present invention is to provide a method meeting such demand.

In order to achieve this object, the present inventors engaged in concentrative studies and discovered that the average particle size of refractory metal oxide in slurry significantly affects the adhesion strength between the oxide on the metal surface and the coating layer of the refractory metal oxide. That is, the present inventors discovered that, by adjusting the average particle diameter of refractory metal oxide in the slurry to be within the range of 0.7-3 microns, a coating layer of the refractory metal oxide of sufficient volume having excellent adhesion strength to metal surface can be formed, even through such a simple process as immersing the metallic surface in the slurry, blowing off the surplus slurry, drying the surface at 100°-300° C., and calcining the same at 400°-800° C. The present inventors also discovered that the coating layer can be rendered still stronger if a minor amount of the refractory metal oxide sol is added to the slurry of refractory metal oxide of which average particle size has been adjusted as above.

Thus, according to the present invention, there is provided a coating method comprising coating a metal having a metal oxide film with a refractory metal oxide using an aqueous slurry containing said refractory metal oxide, which is characterized in that said refractory metal oxide has an average particle diameter ranging from 0.7 to 3 microns; and also a method comprising coating a metal having a metal oxide film with a refractory metal oxide using an aqueous slurry containing said refractory metal oxide, which is characterized in that said refractory metal oxide has an average particle size ranging from 0.3 to 7 microns, and in that the aqueous slurry also contains sol of said refractory metal oxide.

The metal to be used as the base or substrate in the present invention is not particularly limited, so long as it has a film of metal oxide. Normally such metals as iron, chromium, nickel, cobalt, manganese, aluminum, vanadium, titanium, niobium and molybdenum may be used. When the metal as coated with refractory metal oxide is to be used as the catalyst, iron alloys which exhibit sufficient heat stability and oxidation resistance are preferred. Particularly the effect of this invention can be better achieved with the use of ferritic stainless steel alloy composed of 3-40% by weight of chromium, 1-10% by weight of aluminum, 0-1.0% by weight of yttrium as an optional component and the balance of iron.

The type of metal oxide forming a film on the metal surface is not particularly limited, so long as it is an oxide of the element(s) constituting the metal substrate. With the ferritic stainless steel alloy containing aluminum, it is discovered that the aluminum oxide film formed on the surface by heating the alloy in air at 900° C.-1,000° C. excellently exhibits the effect of this invention. Particularly the whiskers of aluminum oxide formed on the alloy surface by the heat treatment in accordance with the method disclosed in U.S. Pat. No. 4,279,782 is the best suited for the present invention.

Obviously the metals usable in the present invention are not limited to those having metal oxide films with above-described surface conditions, but may be, for example, those having metal oxide films with pitting formed by electrolysis or the like.

Examples of refractory metal oxide to be coated on such metals include alumina, silica, titania, zirconia, alumina-silica, alumina-titania, alumina-zirconia, silica-titania, silica-zirconia and titania-zirconia. For the coating on the metals having aluminum oxide on their surfaces, use of alumina, particularly active alumina, is preferred. Again according to the method of this invention, above-named refractory metal oxides further carrying such noble metals as platinum, palladium, rhodium, iridium and the like; base metals such as chromium, manganese, iron, cobalt, nickel, copper and the like; and rare earth elements such as lanthanum, cerium, neodymium and the like can be coated on metal surfaces. Those noble metals, base metals and rare earth elements may also be present in the refractory metal oxide as mixed in the form of corresponding oxide.

The aqueous slurry of refractory metal oxide to be used in the present invention can be prepared by, for example, dispersing active alumina of average particle diameter in the order of 50 microns in diluted aqueous nitric acid, and wet-grinding the same to obtain the afore-specified average particle diameter.

According to the present invention, such an aqueous slurry in which the refractory metal oxide has an average particle diameter ranging from 0.7 to 3 microns is useful. Particularly the aqueous slurry in which the refractory metal oxide has an average particle diameter of 1-2 microns and the particle size distribution containing not more than 10% by weight of the particles having the diameters greater than 10 microns is preferred.

According to a preferred embodiment of the present invention, the refractory metal oxide coating layer of an optional amount of up to 200 g per liter of the carrier (normally from 50 to 150 g/liter of the carrier) is formed on the metallic carrier surface with excellent adhesion strength, said metallic carrier being that obtained by alternately superposing approximately 60-microns thick metal foil composed of an aluminum-containing ferritic stainless steel alloy and having an oxidized surface that is substantially covered by high-aspect alumina whiskers, which is obtained by the heat treatment disclosed in U.S. Pat. No. 4,279,782, and corrugated sheet of this foil which has been given 2.5-mm pitch corrugations, and molding so formed laminate.

Examples of sol of refractory metal oxide include alumina sol, silica sol, titania sol and zirconia sol may be named. The combination of such a sol and the refractory metal oxide in the aqueous slurry is not particularly limited, so long as the combination does not impair slurry stability. When the refractory metal oxide in the aqueous slurry is alumina, however, alumina sol is preferred.

Preferred amount of the sol is such that will render the weight ratio of the refractory metal oxide in the aqueous slurry having an average particle diameter of 0.7-3 microns to the refractory metal oxide in the sol 30:1-8:1, particularly 20:1-10:1. If the amount of sol is so small as to render the above weight ratio less than 30:1, remarkable effect of strengthening the coating layer cannot be obtained. Whereas, if it is more than that to make the weight ratio more than 8:1, the slurry tends to have an excessively high viscosity or the coating layer may become too dense and brittle.

The refractory metal oxide in the sol is present as very fine particles, having an average particle diameter not greater than 0.1 micron, normally not greater than 0.05 micron. When the sol is caused to be concurrently present in the aqueous slurry in an amount within the above-specified range, numerically the average particle diameter of refractory metal oxide in the aqueous slurry as specified in this invention substantially remains the same. When a slurry in which the refractory metal oxide has an average particle size substantially deviating from the specified range of this invention is used, furthermore, even the concurrent presence of sol cannot improve the adhesion strength of the coating layer to the metal surface.

Hereinafter working examples of this invention and comparative examples will be given to more specifically explain the present invention.

EXAMPLE 1

Metal foil composed of an aluminium-containing ferritic stainless steel alloy and having an oxidized surface that is substantially covered by high-aspect alumina whiskers and corrugated sheet of this foil given 2.5-mm pitch corrugations were alternately superposed to form a laminate, from which a 30-mm high, 30-mm wide and 50-mm long rectangular parallelopiped metallic carrier having 475 cells/in$^2$. was molded. The carrier had a volume of about 45 ml.

Five-hundred (500) g of active alumina powder having a surface area of 120 m$^2$/g and an average particle diameter of 50 microns was dispersed in 500 g of diluted aqueous nitric acid, and the dispersion was wet-ground in a ball mill for 20 hours to provide a coating slurry. When measured with SEDIGRAPH 5000D (product of Micromeritics Co.), the slurry was found to have an average particle diameter of 1.0 micron and the particle size distribution that 5% by weight of the particles had the diameters greater than 10 microns. The slurry had a viscosity of 50 cp (at 20° C.). This temperature was used throughout the following Examples and Comparative Examples for measuring slurry viscosity.)

The metallic carrier as above-described was immersed in this coating slurry, withdrawn therefrom, and the excessive slurry in the cells was blown off with compressed air to remove plugging of all the cells. This carrier was dried in a dryer for 3 hours at 150° C., and successively calcined in an electric oven for 3 hours at 600° C., to provide an active alumina-coated metallic carrier. The coating amount of active alumina (w) was 5.4 g.

EXAMPLE 2

An active alumina-coated metallic carrier was prepared through identical procedures with Example 1, except that an active alumina slurry having an average particle diameter of 2.0 microns, a particle size distribution that 7% by weight of the particles had the diameters greater than 10 mcirons, and a viscosity of 45 cp was used. The coating amount (w) of active alumina was 5.3 g.

EXAMPLE 3

An active alumina-coated metallic carrier was obtained through identical procedures with Example 1, except that an active alumina slurry having an average particle diameter of 3.0 microns, a particle size distribution that 10% by weight of the particles had the diameters greater than 10 microns, and a viscosity of 40 cp was used. The coating amount of active alumina (w) was 5.2 g.

COMPARATIVE EXAMPLE 1

An active alumina-coated metallic carrier was obtained through identical procedures with Example 1, except that an active alumina slurry having an average particle diameter of 0.5 micron, a particle size distribution that 3% by weight of the particles had the diameters greater than 10 microns, and a viscosity of 150 cp was used. The coating amount of active alumina (w) was 5.8 g.

COMPARATIVE EXAMPLE 2

An active alumina-coated metallic carrier was obtained through the procedures identical with those of Example 1, except that an active alumina slurry having an average particle diameter of 5.0 microns, a particle size distribution that 25% by weight of the particles had the diameters greater than 10 microns, and a viscosity of 15 cp was used. The coating amount of active alumina (w) was 5.0 g.

EXAMPLE 4

To the active alumina slurry having an average particle diameter of 1.0 micron which was obtained in the manner similar to Example 1, Alumina Sol AS-520 manufactured by Nissan Chemicals was added in such an amount that the ratio of alumina weight in the slurry to that in the alumina sol became 15:1, and dispersed with a homomixer. Thus an active alumina slurry in which alumina sol was concurrently present was obtained.

The metallic carrier same to that used in Example 1 was immersed in this slurry, withdrawn, and the excessive slurry in the cells was blown with compressed air to remove plugging of all the cells. This carrier was dried in a dryer for 3 hours at 150° C., and successively calcined in an electric oven for 3 hours at 600° C., to provide an active alumina-coated metallic carrier. The coating amount of active alumina (w) was 5.5 g.

COMPARATIVE EXAMPLE 3

An active alumina slurry concurrently containing alumina sol was prepared through identical procedures with Example 4 except that the active alumina slurry having an average particle diameter of 5.0 microns obtained as in Comparative Example 2 was used. Using this slurry, the metallic carrier was coated with active alumina. The coating amount of active alumina (w) was 5.4 g.

TEST EXAMPLE

The active alumina-coated metallic carriers obtained in Examples 1 through 4 and Comparative Examples 1 through 3 were first subjected to the coating layer adherence test using an ultrasonic washer as described below.

The sample active alumina-coated metallic carrier was dried in a dryer for 3 hours to 150° C., cooled to room temperature in a desiccator and measured of its weight ($W_0$ g).

A fine stainless wire was passed through the cell at the center part of the carrier, to hang the carrier in the water contained in the container of an ultrasonic washer (BRANSONIC 220, manufactured by Smith Kline and Co.), while preventing the carrier from contacting with the container wall. The ultrasonic washer was operated for 20 minutes, and then the coating layer adherence test was performed.

Then the carrier was washed with water, and blown with compressed air to be removed of excessive water, followed by drying in a dryer for 3 hours at 150° C. and cooling in a desiccator to room temperature. The carrier weight after the test ($W_1$ g) was measured.

The weight loss of the coating layer ($W_0$—$W_1$) was divided by the weight of coating layer before the test (w g), to determine the percent weight loss A (%) by the expression below.

$$\text{Percent weight loss } A\ (\%) = \frac{W_0 - W_1}{w} \times 100$$

The results were shown in Table 1.

Then the seven types of metallic carriers obtained in Examples 1-4 and Comparative Examples 1-3 were each filled in a multiconverter and connected to an exhaust system of a car engine (8 cylinders; displacement =4400 cc), and subjected to the coating layer adherence test under the actual conditions of use of automobile catalyst. The engine was run for 100 hours at 2,800 r.p.m., under a booster pressure of −250 mmHg and the temperature at the converter entrance of 750° C. Thereafter the metallic carrier was withdrawn from the converter and the deposited carbon was removed by calcining the same in air in an electric oven for 5 hours at 600° C. Thereafter the carrier was cooled to room temperature in a desiccator, and the weight of the carrier after the test ($W_2$ g) was measured.

The weight loss of the coating layer ($W_0$−$W_2$) was divided by that of the coating layer before the test (w g), and the percent weight loss B (%) was determined by the equation below.

$$\text{Percent weight loss } B\ (\%) = \frac{W_0 - W_2}{w} \times 100$$

The results were also shown in Table 1.

TABLE 1

| | Average particle diameter of alumina (micron) | Concurrent presence of sol | Percent weight loss A (%) | Percent weight loss B (%) |
|---|---|---|---|---|
| Example 1 | 1.0 | no | 5 | <1 |
| Example 2 | 2.0 | no | 5 | <1 |
| Example 3 | 3.0 | no | 7 | <1 |
| Example 4 | 1.0 | yes | 3 | <1 |
| Comparative Example 1 | 0.5 | no | 50 | 15 |
| Comparative Example 2 | 5.0 | no | 90 | 23 |
| Comparative Example 3 | 5.0 | yes | 80 | 20 |

As should be apparent from Table 1, scarcely any weight loss took place with the coating layers of Examples 1 through 4 in the coating adherence test performed in the ultrasonic washer. Furthermore, the effect of the concurrent presence of sol is appreciable with the coating layer of Example 4. In contrast thereto, the coating layers of Comparative Examples 1-3 showed substantial weight loss, irrelevantly to the concurrent presence of sol. Also in the coating adherence test using the engine exhaust gas, the coating layers of Examples 1-4 showed excellent stability compared with those of Comparative Examples 1-3. That is, it is clearly demonstrated that the coating layers in accordance with the present method markedly excel in durability under the actual conditions of use. This indicates that the catalyst carried on so coated metallic carrier shows high reliability, excelling in physical durability.

From the foregoing test results, it is confirmed that the aqueous slurry in which the average particle diameter of refractory metal oxide is adjusted to 0.7-3 microns in accordance with the present invention forms a strong coating layer on the metal surface covered with metal oxide film.

What we claim is:

1. A coating method comprising immersing a metallic carrier having a metal oxide film in an aqueous slurry, said slurry containing a refractory metal oxide having an average particle diameter of 0.7 to 3 microns and a sol of a refractory metal oxide wherein the weight ratio of the refractory metal oxide having an average particle diameter of 0.7 to 3 microns to the refractory metal oxide in the sol is 30:1 to 8:1, blowing off the surplus slurry from the carrier, drying the carrier and calcining the carrier.

2. The method of claim 1 in which the refractory metal oxide having an average particle diameter of 0.7 to 3 microns is active alumina.

3. The method of claim 1 or 2 in which the metallic carrier having a metal oxide film is aluminum-containing ferritic stainless steel alloy.

4. The method of claim 2 in which the sol of refractory metal oxide is alumina sol.

5. The method of claim 1 wherein the carrier is dried at 100° C. to 300° C. and calcined at 400° C. to 800° C.

6. The method of claim 1 in which said refractory metal oxide has an average particle diameter of 1 to 2 microns.

7. The method of claim 1 in which said weight ratio of the refractory metal oxide having an average particle diameter of 0.7 to 3 microns to the refractory metal oxide in the sol is 20:1 to 10:1.

8. A coating method comprising coating an aluminum-containing ferritic stainless steel alloy with an aqueous slurry of a refractory metal oxide having an average particle diameter ranging from 0.7 to 3 microns, said aqueous slurry also containing a sol of a refractory metal oxide and drying.

9. The method of claim 8 in which the amount of refractory metal oxide is such that the weight ratio of the refractory metal oxide having an average particle diameter ranging from 0.7 to 3 microns to the refractory metal oxide in the sol in the aqueous slurry is 30:1 to 8:1.

10. A coating method comprising coating an aluminum-containing ferritic stainless steel alloy with an aqueous slurry of active alumina having an average particle diameter ranging from 0.7 to 3 microns, said aqueous slurry also containing a sol of active alumina and drying.

11. The method of claim 10 in which the amount of active alumina is such that the weight ratio of the active alumina having an average particle diameter ranging from 0.7 to 3 microns to the active alumina in the sol in the aqueous slurry is 30:1 to 8:1.

12. The method of claim 1 or 3 in which said aluminum-containing ferritic stainless steel alloy contains 1 to 10% by weight of aluminum.

* * * * *

UNITED STATES PATENT AND TRADEMARK OFFICE

CERTIFICATE OF CORRECTION

PATENT NO. : 4,731,261

DATED : March 15, 1988

INVENTOR(S) : KAZUO TSUCHITANI, ET AL.

It is certified that error appears in the above-identified patent and that said Letters Patent is hereby corrected as shown below:

IN THE CLAIMS

Column 8, claim 12, line 1, delete "1 or 3", insert --8 or 10--.

Signed and Sealed this

Sixteenth Day of August, 1988

*Attest:*

*Attesting Officer*

DONALD J. QUIGG

*Commissioner of Patents and Trademarks*